United States Patent [19]

McDonie et al.

[11] 4,002,735

[45] Jan. 11, 1977

[54] METHOD OF SENSITIZING ELECTRON EMISSIVE SURFACES OF ANTIMONY BASE LAYERS WITH ALKALI METAL VAPORS

[75] Inventors: Arthur Frederick McDonie, Lancaster, Pa.; Charles Michael Tomasetti, Turnersville, N.J.

[73] Assignee: RCA Corporation, New York, N.Y.

[22] Filed: June 4, 1975

[21] Appl. No.: 583,746

[52] U.S. Cl. ..... 427/78; 427/77; 427/250; 427/377; 427/380; 427/383 R; 427/383 A; 427/383 B; 427/383 C; 316/5; 316/6; 316/8; 316/12

[51] Int. Cl.[2] ..... H01J 9/22; B05D 5/12

[58] Field of Search ..... 427/77, 78, 399, 250, 427/380, 383 A, 383 B, 383 R, 383 C, 377; 316/5, 6, 8, 10, 12, 20, 24

[56] References Cited

UNITED STATES PATENTS

| | | | |
|---|---|---|---|
| 2,914,690 | 11/1959 | Sommer | 316/6 |
| 3,372,967 | 3/1968 | Hughes | 316/5 |
| 3,658,400 | 4/1972 | Heluy | 316/5 |
| 3,753,023 | 8/1973 | Sommer | 427/78 |
| 3,838,304 | 9/1974 | McDonie | 316/5 |
| 3,884,539 | 5/1975 | Sommer | 316/6 |

*Primary Examiner*—Michael F. Esposito
*Attorney, Agent, or Firm*—Glenn H. Bruestle; William H. Murray

[57] ABSTRACT

In a photomultiplier tube, antimony layers of a photocathode and a plurality of dynodes are simultaneously sensitized by exposure to the vapors of sodium and potassium at an initial temperature of less than about 120° C. The temperature of exposure is gradually increased at a rate of less than about 10° C. per minute until a final temperature of about 200° C. is reached. Then, the photocathode and dynodes are baked at the final temperature until substantially maximum photosensitivity is achieved. The photocathode and dynodes are thereafter exposed to cesium and may be superficially oxidized until substantially maximum photosensitivity is achieved.

6 Claims, 2 Drawing Figures

METHOD OF SENSITIZING ELECTRON EMISSIVE SURFACES OF ANTIMONY BASE LAYERS WITH ALKALI METAL VAPORS

BACKGROUND OF THE INVENTION

This invention relates to the art of making electron emission surfaces and more particularly to multialkali activation or sensitization or methods applicable to such surfaces.

Methods of sensitizing electron emissive surfaces of, for example, supported base layers of antimony are well known in the art of electron discharge devices. Such methods generally relate to the sensitization of either photocathodes or secondary emissive electrodes. Photoemissive materials and techniques relating thereto are, for example, described in *Photoemissive Materials* by A. H. Sommer, John Wiley and Sons, Inc., New York, 1968 and is herein incorporated by reference. Unfortunately, while various methods or techniques may be effectively employed to maximally sensitize one or the other of these types of electron emissive electrodes, individually, no one method has been found which permits the multialkali sensitization of both photosensitive and secondary emissive type electrodes simultaneously within the same processing apparatus without substantially impairing the achievable performance characteristics of one or the other of the types of electrodes.

In the manufacture of photomultipliers, it is highly desirable to simultaneously sensitize both a multialkali type photocathode and a plurality of dynode or secondary emissive electrodes subsequent to their assembly within a common tubular envelope. In general, selection of any of the known prior art sensitization schedules, suitable for maximizing the sensitivity of the photocathode, results in the simultaneous formation of an inferior secondary emissive dynode, electrode, or vice versa.

A compatible method suitable for sensitizing photoemissive and secondary emissive type electrode surfaces simultaneously in the same processing apparatus is highly desired whereby improved overall response characteristics may be achieved for devices employing both types of electrodes.

SUMMARY OF THE INVENTION

Antimony layers of a photocathode and/or a plurality of dynodes are simultaneously sensitized with the vapors of a plurality of alkali metals by exposure to such vapors at an initial temperature of less than about 120° C. The temperature of exposure is gradually increased at a rate of less than about 10° C. per minute until a final temperature of about 200° C. is reached. Then, the surfaces so exposed are baked at the final temperature until substantially maximum photosensitivity is achieved. The photocathode and dynodes are thereafter exposed to cesium and may be superficially oxidized until substantially maximum photosensitivity is achieved.

PREFERRED EMBODIMENTS

Figure 1:
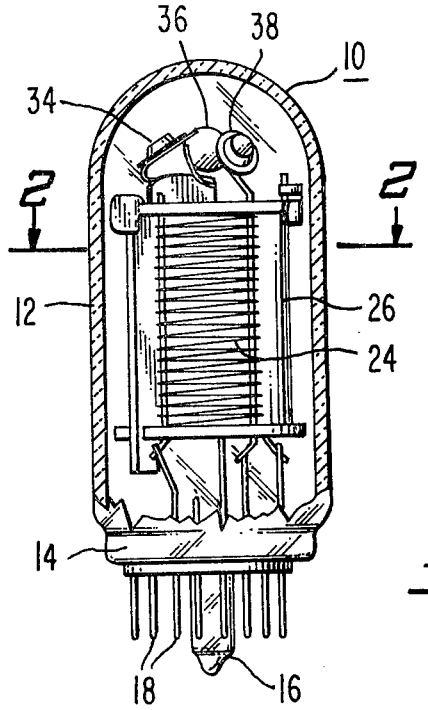
FIG. 1 is a cut-away side view of a photomultiplier tube having a photocathode and a plurality of dynodes in accordance with the invention.
Figure 2:
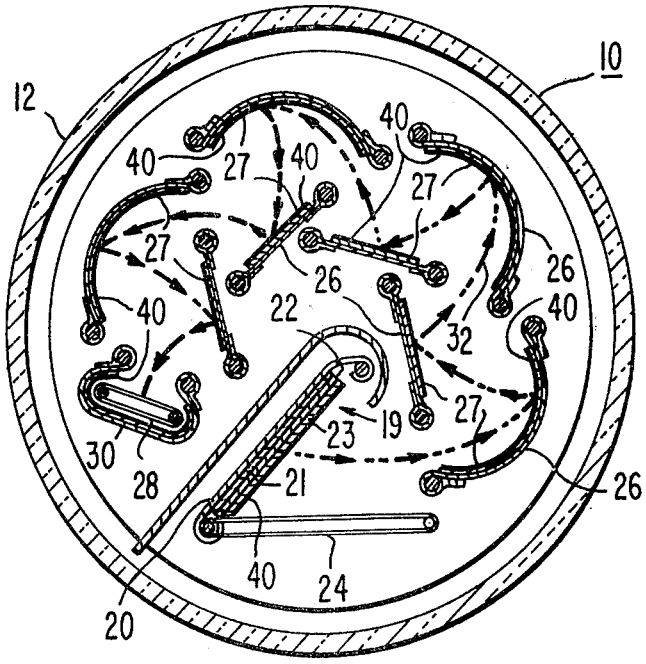
FIG. 2 is a non-scale cross-sectional view of the tube of FIG. 1 taken along line 2—2 in which the electrodes are shown in greatly exaggerated detail.

In a preferred embodiment of the invention, the photomultiplier tube 10, shown in FIGS. 1 and 2, is processed by the novel method to activate or sensitize simultaneously various electron emissive surface portions of a plurality of electrodes within the tube's interior.

Referring now to FIG. 1, the tube 10 has a glass envelope 12, with a stem portion 14. The stem portion 14 includes a length of exhaust tubulation 16 and a number of embedded metal pins 18 for making electrical contact to the electrodes within the interior of the tube 10.

Mounted inside the tube 10 is an electrode assembly including the electrodes of tube 10 which are shown in greatly exaggerated detail in FIG. 2. The electrode assembly include a photocathode 19 comprising, in overlay sequence: a nickel supporting substrate 20, a thin film of manganese oxide 21 along a major surface of substrate 20, and evaporated porous and solid antimony layers 22 and 23, respectively, overlying the manganese oxide film 21. Angularly disposed from the photocathode 19 is a mesh electrode 24, which is followed, proceeding counter-clockwise about the tube axis, by a series of eight dynodes 26 and an anode 28 with an anode shield 30. The dynodes 26 and shield 30 comprise a self-supporting nickel supporting substrate with a major surface including a thin film of solid antimony 27.

In the operation of tube 10, the general direction of travel of electrons emitted from the photocathode 19 is indicated by the dashed directional lines 32.

Located within the tube 10 between the electrode assembly and the top of the tube 10, are an enclosed potassium evaporation boat 34, an enclosed sodium evaporation boat 36, and an enclosed cesium evaporation boat 38. These boats may be either electrically resistance-heated, or heated by RF heating methods, well known in the art, during processing to release alkali metal vapors from a charge of reactant material placed within a central cavity within their interior.

As a preliminary step to activation of the photocathode 19 and dynodes 26 to ultimately achieve the desired electron emissivity from a plurality of electrode surface portions 40, after assembly of the tube 10, an oven is placed around the tube 10 and the tube is baked out and evacuated for a period of from 1 to 3 hours at a temperature of from about 260° to about 300° C. to eliminate contaminants from the interior. The tube 10 is thereafter cooled to room temperature.

During the entire processing, the interior of the tube is continually evacuated through the exhaust tubulation 16 by a pump system (not shown) interconnected thereto which is capable of establishing initial pressure levels of less than about $10^{-4}$ torr (preferably, pressure levels less than about $10^{-5}$ torr) within the tube interior.

After the tube 10 is baked out, the activation of exposed surface portions of photocathode 19 and the dynodes 26 which are to be sensitized by exposure to the vapors of a plurality of alkali metals may procede in the manner hereinafter described in Examples 1 and 2. The photosensitivity of the photocathode 19 is continually monitored during processing in the manner hereinafter described. In the Examples 1 and 2 described, the permitted range of the variables is indicated parenthetically subsequent to the preferred values.

EXAMPLE 1

1. After the temperature of the tube 10 is lowered from the bake-out temperature to approximately room temperature, the sodium evaporation boat 36 is flashed by one of the aforementioned heating methods so that sodium vapor is released throughout the interior of the tube 10. Thereafter, the potassium evaporation boat 34 is flashed in a similar manner so that potassium vapor is released throughout the interior of the tube. The potassium and sodium vapors condense along the cool internal portions of the tube 10. Subsequent heating of the tube 10 as hereinafter described reevaporates the condensate so formed, thereby dispelling vapors of the alkali metals throughout the tube's interior.

2. Next, the tube 10 is heated and maintained at a stable temperature of about 100° C. (less than 120° C.) for a period of about 5 minutes (greater than or equal to about 5 minutes). Thereafter, the temperature to which the tube 10 is subjected is gradually increased at an "average" rate of about 3° C. (2° C.–10° C.) per minute until a final temperature of about 190° C. (190° C.–210° C.) is achieved. The tube 10 is then baked at that final temperature until substantially maximum photosensitivity is achieved. The tube 10 is then cooled to approximately room temperature. In the aforegoing step, the actual rate (as opposed to the "average rate") of increase in the temperature to which the tube 10 is subjected may be varied to advantage depending upon circumstances. However, the variation in temperature appears to become somewhat critical when temperatures approacing 190° C. are achieved, thereby necessitating closer control with respect to the preferred 3° C. "average" rate of temperature increase noted above.

3. With the tube 10 still maintained at room temperature the cesium evaporation boat 38 is flashed to release cesium vapor within the tube interior. Thereafter, tube 10 is preferably heated and maintained at a stable temperature of about 100° C. (70° C.–120° C.) for a period of about 5–10 minutes. Then, the temperature to which the tube 10 is subjected is gradually increased at a rate of about 10° C. (5° C.–20° C.) per minute until a final temperature of about 170° C. (160° C.–180° C.) is achieved. The temperature to which the tube 10 is subjected during this step is thus gradually increased to avoid thermal shock which might otherwise crack or damage the envelope of tube 10. Alternatively, the tube 10 may be placed in a preheated oven having a temperature of about 160° C. to 180° C. for a period of time sufficient to cause cesium to evaporate and react as a vapor with the electron emissive surfaces to be sensitized.

The tube 10 is now baked at the final temperature of 170° C. (160° C.–180° C.) until substantially maximum photosensitivity is achieved. The tube 10 may thereafter be cooled to room temperature and the processing terminated by sealing off the exhaust tubulation 16 in a conventional manner.

EXAMPLE 2

In this Example, steps 1 through 3 of Example 1 are performed in sequence; however, before finally cooling the tube 10 to room temperature and discontinuing the processing by sealing the tubulation 16, the following additional step is performed:

The tube 10 is slowly cooled to a temperature of about 100° C. (90° C.–120° C.) at a rate of about 5° C. (less than about 10° C.) per minute. When the temperature reaches approximately 100° C. (90° C.–120° C.), oxygen is admitted through the tubulation 16 into the tube interior at low pressure levels of less than about $5 \times 10^{-6}$ torr ($1 \times 10^{-6}$ torr-$5 \times 10^{-5}$ torr) to superficially oxidize the electron emissive surface portions. Exposure of the tube interior to oxygen is continued in this manner until substantially maximum photosensitivity is achieved.

The novel method is unique in that not only is the photocathode activated by a plurality of vapors of alkali metals to achieve exceedingly high photosensitivity, but such processing also produces an exceedingly sensitive multialkali-type secondary emissive surface along the antimony surfaces of each of the dynode electrodes. As a consequence of this "compatability" of the novel process for activating photoemissive as well as secondary-emissive type surfaces tubes processed by the novel method of Example 1 possess extremely high overall sensitivity characteristics. For example, in contrast to similar tubes processed by the prior art activation methods having achievable overall anode sensitivities of less than about 600 Amperes per lumin of incident tungsten light input signal to the photocathode, tubes processed by the novel processes have consistently achieved overall anode sensitivities approaching 1500 Amperes per lumin for a similar tungsten light source test input signal of $10^{-8}$ lumens intensity.

Tubes processed by the novel method of Example 2 have been evaluated and found to possess extended red response characteristics above 800 nm. It has been found that the additional processing of Example 2 increases the sensitivity of the photocathode at 600 nm. by from about 20% to about 100% and extends the useful spectral response of the tube processed to as high as 860 nm., in contrast to a corresponding sensitivity at about 750 nm., associated with a tube processed without the additional step of Example 2. Tubes processed in accordance with Example 2 have consistently achieved anode sensitivities exceeding 2000 Amperes per lumen of incident test input light signal of $10^{-8}$ lumens intensity from a tungsten filament light source. In fact, some of such tubes have achieved anode sensitivities approaching 8000 Amperes per lumen. The above-noted comparative tests were performed by employing interstage electrode potentials of approximately 100 volts in a manner well known in the art and substantially similar test conditions were employed in each case.

GENERAL CONSIDERATIONS

Throughout the processing described in Examples 1 and 2 the photosensitivity and/or overall sensitivity, of the tube 10 is continually monitored by suitable external metering circuitry (not shown) while simultaneously applying suitable electrode potentials and while simultaneously illuminating the photocathode 19 with a suitable input light signal of desired spectral intensity characteristics. Typically, the surface of the photocathode is illuminated by 1/10 of a lumen tungsten filament light source. During such monitoring, typical electrical potentials of about 100V. may be applied between the photocathode and the first dynode electrode upon which emitted electrons from the photocathode first impinge. The current of the photocathode or first dynode circuit may be monitored to provide a relative indication of photosensitivity of the tube 10 during the aforementioned processing. Alternatively, the relative overall sensitivity of the tube 10 may also be continually monitored by applying suitable interstage electrode potentials to one or more of the other succeeding dynodes or anode electrodes and thereafter monitoring the current achieved in the interconnecting circuitry in a manner well known in the art.

During the processing herein disclosed, the photosensitivity measurements on the tube 10 were monitored by the earlier described cathode current metering technique; however, the overall sensitivity measuring technique may be employed to equal advantage by incorporating suitable adjustments in the processing.

Maximum sensitivity is determined from the first derivative of the increasing sensitivity function. The first derivative takes a zero value at the peak of a sensitivity curve. However, in the course of an alkali metal evaporation there are often a number of spurious peaks in the sensitivity which are of lower values than a later highest maximum peak. In order to discriminate these spurious peaks from the maximum it is necessary to continue evaporation until the sensitivity has fallen to a value slightly below (e.g. about 80 percent of) the sensitivity at the actual peak. It may then be assumed that the peak was the highest attainable for that evaporation and is therefore a maximum. A reference herein to evaporation of an alkali metal to a "substantially maximum photosensitivity" means an evaporation past the maximum an amount necessant to establish the sensitivity is reasonably close to the real maximum. Excess alkali evaporated after a maximum is reached generally evaporates off again during subsequent baking.

Reactant materials which are suitable for processing a tube 10 having a 1 ⅛ inch diameter comprise, for example, the following:

| Alkali Vapor Desired | Reactants |
|---|---|
| Sodium: | 40 Milligram mixture of sodium chromate with either silicon or zirconium |
| Potassium: | 35 Milligram mixture of potassium chromate with either silicon or zirconium |
| Cesium: | 60 Milligram mixture of cesium chromate and silicon |

During the assembly of the tube, prior to the processing herein disclosed, a suitable charge of reactant material is placed within a central cavity of a metal dish-like container portion of each of the evaporation boats 34, 36, 38. A cover is secured across the top of the dish-like container to retain the reactant material within the boat interior. A plurality of through openings into the interior of each of the boats 34, 36, 38 provide a means whereby the alkali vapors may be dispelled during processing within the interior of the tube 10 as a consequence of the flashing procedure.

As herein disclosed, the "flashing" of the evaporation boats is achieved by heating the individual boats to a temperature of, for example, from about 600° C. to about 700° C. for a period of time suitable for producing an exothermic reaction of their respective charges of reactant material to produce the respective alkali metal vapors.

The novel process may be used to activate or sensitize photoemitters of the reflective or transmissive type, and/or secondary electron emitting surfaces. While the tube structure described is preferred, other structural and/or electrode configurations may be used to advantage. The novel process described is generally applicable to structures having antimony layers or films which require activation or sensitization by reaction with the vapors of a plurality of alkali metal.

While, in the preferred embodiment, evaporation is done by heated evaporation boats inside the tube, external processing can also be used to practice the novel method. Thus, for example, the novel method can be used to form multialkali photocathodes having improved response in tubes, such as image tubes, for which internal processing may not be as useful as external processing because of possible contamination of electrodes.

I claim:

1. A method of making an electron emissive electrode including a supporting base layer of antimony sensitized with the vapors of a plurality of alkali metals comprising the steps of:

a. sensitizing the base layer by exposing a surface portion thereof to the vapors of at least two alkali metals at a pressure level of less than $10^{-4}$ torr and at an initial temperature of less than about 120° C.; then, b. continuing said exposure of step (a) while gradually increasing said temperature to a final temperature of about 200° C. at an average rate of less than about 10° C. per minute; then, c. baking the electrode at said final temperature until substantially maximum photosensitivity is achieved.

2. The method of claim 1 wherein said base layer is simultaneously sensitized with the vapors of potassium and sodium.

3. The method of claim 2, wherein said initial temperature is about 100° C. and wherein said final temperature is about 190° C.

4. The method of claim 3 wherein said average rate of increase of said temperature between said initial and final temperatures is about 3° C. per minute.

5. The method of claim 1 further comprising the step of superficially oxidizing the sensitized electron emissive surface portion resulting from step (c) until substantially maximum photosensitivity is achieved.

6. The method of claim 5 wherein said oxidation step comprises exposing said surface portion to oxygen at a pressure level of less than $5 \times 10^{-5}$ torr at a temperature of about 100° C.

* * * * *

UNITED STATES PATENT OFFICE
CERTIFICATE OF CORRECTION

PATENT NO. : 4,002,735

DATED : January 11, 1977

INVENTOR(S) : Arthur Frederick McDonie et al.

It is certified that error appears in the above-identified patent and that said Letters Patent are hereby corrected as shown below:

Column 2, line 52, after "tube" insert --10.

Column 4, line 24, change "processes" to --process--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*